United States Patent [19]

Anderson

[11] Patent Number: 4,995,293

[45] Date of Patent: Feb. 26, 1991

[54] ACOUSTIC INSTRUMENT WITH INTERNALLY POSITIONED MICROPHONE MEANS FOR RECEIVING ACOUSTICAL VIBRATIONS

[76] Inventor: Peter N. Anderson, 1571 El Camino, #39, Mountain View, Calif. 94040

[21] Appl. No.: 378,465

[22] Filed: Jul. 13, 1989

Related U.S. Application Data

[63] Continuation of Ser. No. 186,726, Apr. 22, 1988, abandoned, which is a continuation of Ser. No. 746,987, Jun. 19, 1987, abandoned, which is a continuation-in-part of Ser. No. 696,327, Jan. 30, 1985, abandoned.

[51] Int. Cl.[5] ..... G10H 3/18

[52] U.S. Cl. ..... 84/733; 84/743

[58] Field of Search ..... 84/1.04, 1.06, 1.11, 84/1.14, 1.16, 329, DIG. 3, 733, 743; 361/380

[56] References Cited

U.S. PATENT DOCUMENTS

| | | | |
|---|---|---|---|
| 2,430,717 | 11/1947 | Hull . | |
| 3,662,223 | 5/1972 | Marshall | 361/380 |
| 3,935,782 | 2/1976 | O'Brien | 84/1.16 |
| 4,351,217 | 9/1982 | Wechter | 84/1.16 |
| 4,495,641 | 1/1985 | Vernino | 84/1.14 X |
| 4,519,287 | 5/1985 | Naruse | 84/743 |
| 4,532,847 | 8/1985 | Youngblood | 84/743 X |

FOREIGN PATENT DOCUMENTS 2331858 11/1975 France .

*Primary Examiner*—Stanley J. Witkowski

*Attorney, Agent, or Firm*—Flehr, Hohbach, Test, Albritton & Herbert

[57] ABSTRACT

An improved acoustic instrument is disclosed. The improvement includes a condenser microphone carried within the body of the acoustic instrument so as to primarily detect acoustical vibrations of the interior air column in contradiction to the mechanical vibrations of the instrument itself to generate electrical signals corresponding to the sounds of the instrument. The electrical signals can then be suitably amplified for connection to a conventional speaker to provide sound truly representing the acoustic sound within the instrument.

14 Claims, 2 Drawing Sheets

ACOUSTIC INSTRUMENT WITH INTERNALLY POSITIONED MICROPHONE MEANS FOR RECEIVING ACOUSTICAL VIBRATIONS

This is a continuation of application Ser. No. 186,726 filed Apr. 22, 1988, now abandoned, which was a continuation of application Ser. No. 746,987 filed June 18, 1985, now abandoned, which was a continuation-in-part of application Ser. No. 696,327 filed Jan. 30, 1985, now abandoned.

BACKGROUND OF THE INVENTION

The present invention relates to an acoustic instrument, and in a preferred embodiment to an acoustic guitar.

Acoustic instruments, such as an acoustic guitar, cello, piano, violin drum, and the like, are of course well known in the art. A problem with presently utilized pick-ups in amplifying the acoustic sound of such instruments is that typically a hollow sound is generated, which is not truly an acoustic sound.

When it is desired to amplify the sound of an instrument such as an acoustic guitar, prior art approaches have been to provide a microphone fixed on a stand and to play the acoustic guitar with the sound hole near the fixed position microphone. This approach restricts movement of the player, as the acoustic guitar must be played usually within twelve inches of the fixed position microphone.

Another prior art approach is to utilize a transducer and magnetic pickup which fit within the body, near the sound hole of the acoustic guitar. However, this approach, while providing mobility for the player, still generates the undesirable hollow sound, or what could be characterized as an electronic sound, and not truly an acoustic sound.

As is known in the art, acoustic guitars improve over the course of time as the guitar wood "mellows." The prior art approaches described above, while providing an amplification of the acoustic sound, generally reflect the sounds of the vibration of the strings and of the wood, but does not provide a true representation of the sound of any harmonics of the acoustic guitar.

A further problem of the prior art approaches above is that microphones located near the sound hole (whether within or without the sound hole) can result in a feedback problem, which can be very annoying and undesirable.

SUMMARY OF THE INVENTION

It is an object of the present invention to provide an improved acoustic instrument.

It is a more particular object of the present invention to provide an improved acoustic guitar which provides for amplification purposes a truer acoustic sound than prior art approaches.

Briefly, the improved instrument includes an electrical jack supported by the end block of an acoustic guitar. The electrical jack is desirably a female jack which can be easily retrofitted into the end block of the acoustic guitar. The electrical jack in turn supports a condenser microphone and hybrid electronic tone filter such that the microphone is positioned within the body of the acoustic guitar near the end block. The condenser microphone and hybrid electronic tone filter generates electrical signals corresponding to the acoustic sounds generated by the acoustic guitar.

The electrical female jack is adapted to receive a male plug which in turn is connected to a sound amplifier and speaker system which will provide amplified sounds corresponding more truly to the acoustic sounds of the guitar itself.

Additional objects, advantages and novel features of the present invention will be set forth in the description which follows, and in part will become apparent to those skilled in the art upon examination of the following or may be learned by practice of the invention. The objects, advantages and features of the invention may be realized and attained by means of the instrumentalities and combinations particularly pointed out in the appended claims.

DETAILED DESCRIPTION OF THE INVENTION

Figure 1:
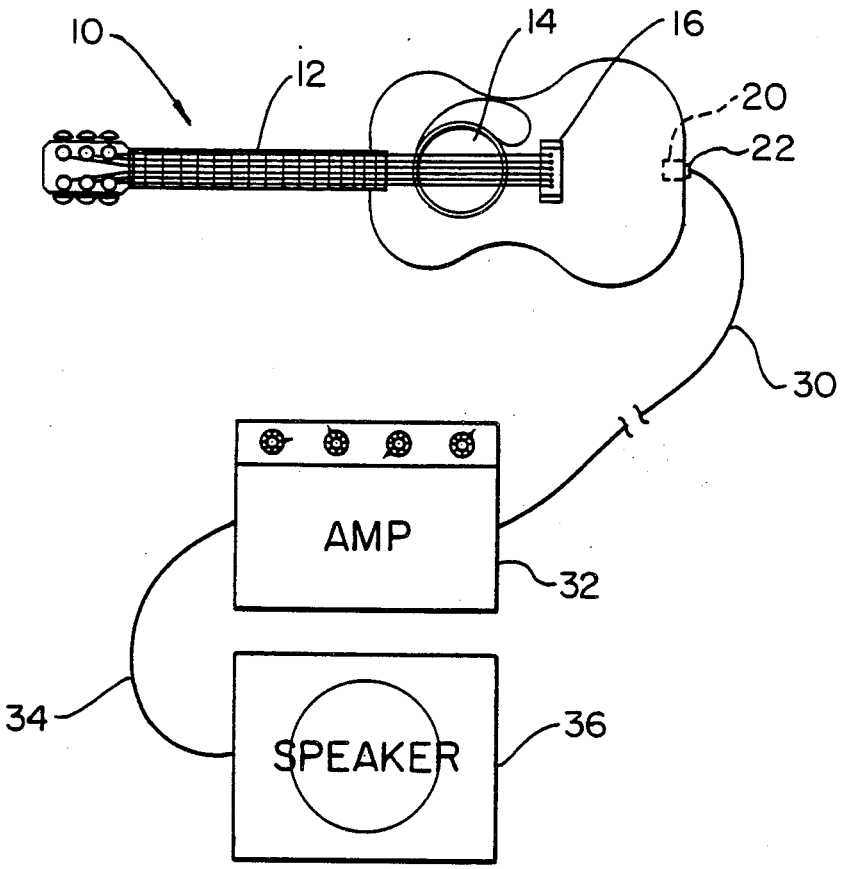
FIG. 1 depicts a block diagram of an acoustic instrument according to the present invention.

Referring now to FIG. 1, an improved acoustic instrument is shown in block diagram form. In a preferred embodiment, the present invention is to be utilized in an acoustic guitar. However, the principles to be described herein are applicable to other acoustic instruments, such as a piano, cello, bass, violin, mandolin and the like. It should be clear that, while the preferred embodiment is to be utilized with an acoustic guitar, the present invention is applicable to other types of acoustic instruments.

Referring now to FIG. 1, an improved acoustic instrument 10 is depicted. The acoustic instrument 10 includes an acoustic guitar 12, which in general could be any acoustic guitar known in the art. An acoustic guitar 12 includes a sound hole 14 and bridge 16.

Acoustic guitar 12 is modified to incorporate the improved apparatus 20, which is desirably carried within the body of acoustic guitar 12 near the end block 22. Apparatus 20 is desirably located within the body of acoustic guitar 12 but removed from sound hole 14 to reduce or eliminate the problem of feedback, as will be described. Locating apparatus 20 near the end block 22 of guitar 12 provides the additional feature of serving as a support for a carrying strap.

Acoustic instrument 10 includes a conventional lead 30 connected to apparatus 20 for connection to a conventional amplifier 32. The amplified output from amplifier 32 is connected via conventional lead 34 to a suitable speaker 36. As will be described, the improved acoustic instrument is to be utilized in an environment where amplified acoustic sounds are desired.

Figure 2:
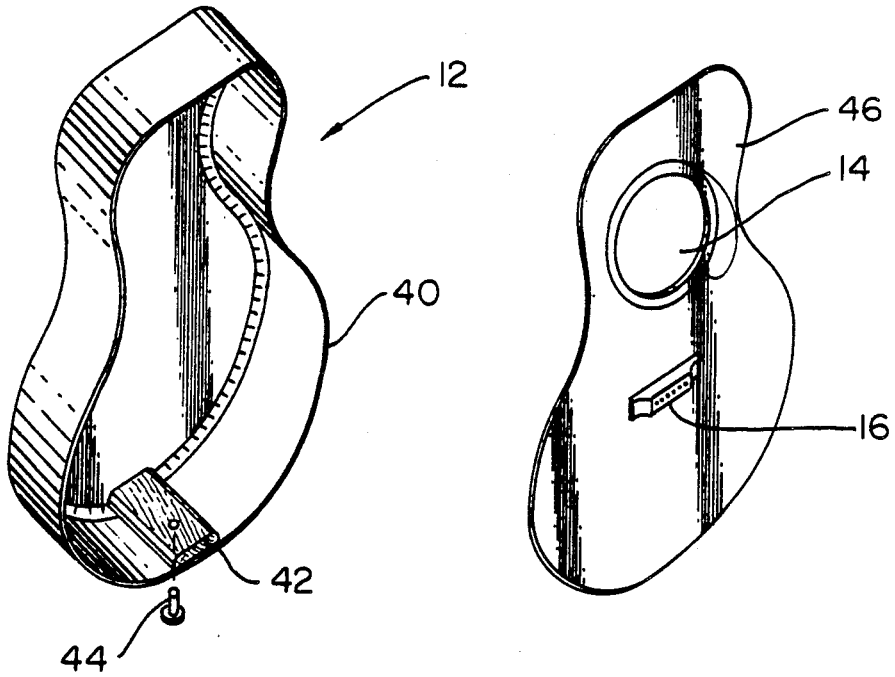
FIG. 2 depicts a perspective exploded view of a prior art acoustic guitar for purposes of simplifying the description of the present invention.

Referring now to FIG. 2, an exploded perspective view of a prior art acoustic guitar 12 is depicted. The prior art acoustic guitar 12 is only shown in partial perspective view for purposes of simplifying the description of the present invention.

Acoustic guitar 12 of FIG. 2 includes a body 40 and end block 42 wherein an end pin 44 is fixably connected to end block 42 to provide a means for supporting a carrying strap (not shown). The present invention can also be utilized as a means for supporting a carrying strap when used in an acoustic guitar.

Acoustic guitar 12 of FIG. 2 also includes a top 46 which is attached to body 40 in a known fashion. Top 46 includes the sound hole 14 and bridge 16. The acoustic guitar illustrated in FIG. 2 is well known in the art and need not be described in any further detail, but is described herein for purposes of simplification of the description of the present invention, as will now be described.

Figure 3:
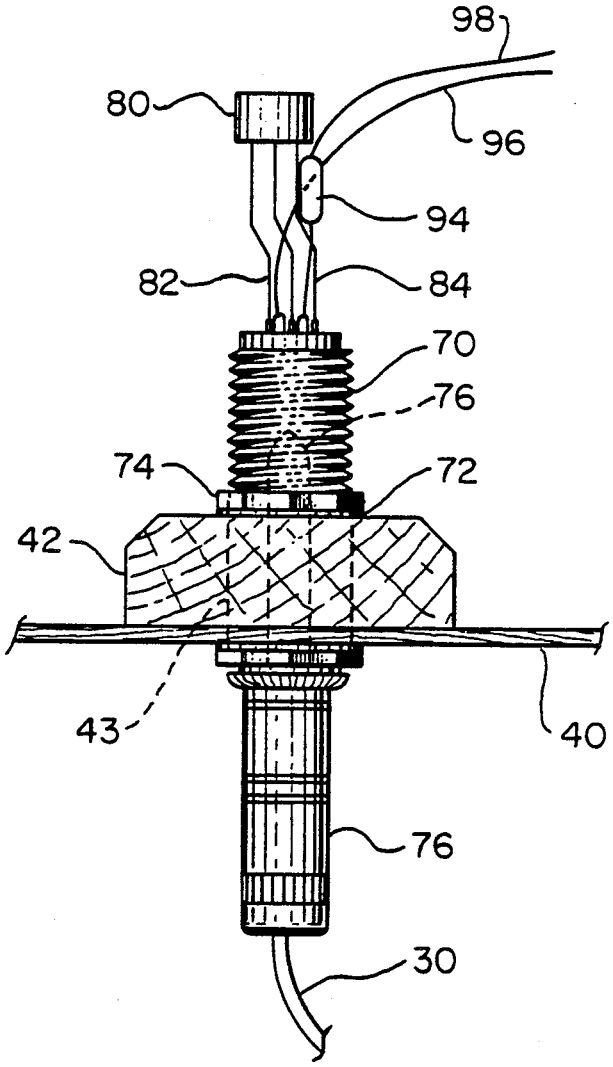
FIG. 3 depicts a view of the improved apparatus incorporated into an acoustic guitar.

Referring now to FIG. 3, a partially exploded, perspective view of an improved acoustic instrument according to the present invention is depicted. In FIG. 3, an acoustic guitar such as that illustrated in FIG. 2 could be utilized. The acoustic guitar of FIG. 3 need only be modified in the following fashion to incorporate the aspects of the present invention.

In FIG. 3, an end block 42 of an acoustic guitar is modified by drilling a hole therethrough somewhat larger than what is normally required for prior art acoustic guitars. End block 42 of FIG. 3 has a hole 43 drilled therethrough to accommodate an electrical female jack 70. The electrical jack is also shown in more detail in FIG. 4.

Figure 4:
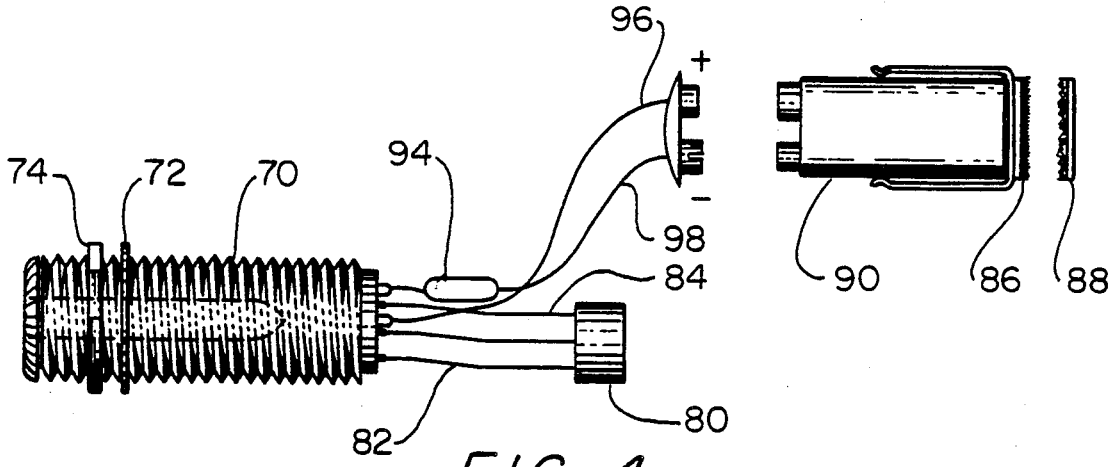
FIG. 4 depicts a detailed view of improved apparatus according to the present invention.

Referring now to FIG. 4, electrical jack 70 can be fixedly connected to acoustic guitar 12 by means of a suitable washer 72 and nut 74. Additional washers and nuts (not shown) could be utilized with electrical jack 70 of FIG. 4 to provide suitable spacing or adjustment capability for locating the present invention within the body of an acoustic guitar. Referring still to FIG. 4, electrical female jack (which typically could be an electrical jack manufactured by Switchcraft) is desirably a stereo type electrical jack. The electrical jack has connected to one end thereof a condenser microphone 80, which could be one such as manufactured by Radio Shack, Inc. The condenser microphone is connected to electrical jack 70 via leads 82, 84. Condenser microphone 80 is desired in a preferred embodiment because of the ease in which it can be connected to electrical jack 70 and further the ease in which the improved apparatus can be inserted into the body of an acoustic guitar. In addition, the frequency response of a condenser microphone is in the range of 20 Hz–15 KHz, while the frequency response of an acoustic guitar is in the range of 80 Hz–650 Hz.

Still referring to FIG. 4, condenser microphone 80 typically requires a suitable power supply of between 2.5–10 volts for proper operation of condenser microphone 80. To accommodate that specification, FIG. 4 depicts power supply (battery) 90 which can be biased via a 1K ohm resistor 94 to provide suitable power supply requirements for condenser microphone 80 via leads 96, 98. In addition, FIG. 4 depicts a battery holder 86 which can be carried within the body of acoustic guitar 40 of FIG. 2 by means of a Velcro attachment 88. Power supply 90 could be located or positioned anywhere within or without the acoustic guitar of FIG. 2. However, for cosmetic purposes it is desired to place power supply 90 within the body of acoustic guitar 12 of FIG. 2 at a suitable location near sound hole 14, so that power supply 90 can be replaced, when necessary, in a simple fashion.

As can be perceived by one of ordinary skill in the art, the apparatus of FIG. 4 provides for engagement with a suitable male electrical plug 76 which in turn is connected to a suitable amplifier, such as amplifier 32 of FIG. 1, to provide amplified electrical signals for connection to a suitable speaker. As can be further perceived by one of ordinary skill in the art, the apparatus depicted in FIG. 4 can be easily retrofitted within a conventional existing acoustic guitar. In a preferred embodiment, the condenser microphone 80 can be desirably located near end block 42 of FIG. 3. This is to minimize any feedback problems which might occur otherwise.

Figure 5:
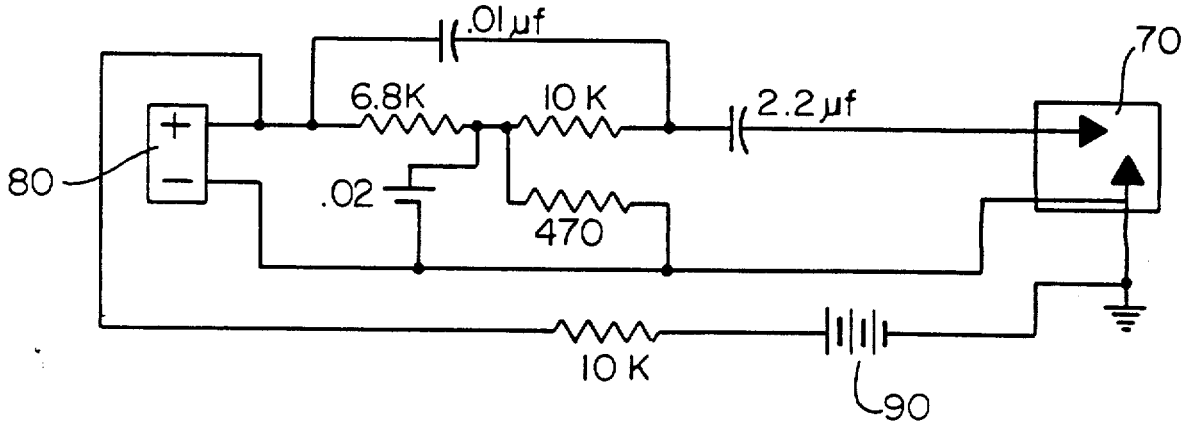
FIG. 5 depicts a schematic diagram of a tonal filter which is incorporated into another preferred embodiment of the present invention.

FIG. 5 depicts a schematic diagram of a tonal filter 100, which, in a preferred embodiment, replaces the resistor 94 of FIG. 4. Tonal filter 100 is connected to a power supply such as battery 90 of FIG. 4, together with microphone 80 and jack 70 of FIG. 4.

The tonal filter 100 of FIG. 5 provides electrical specifications for a flatter tone response for the present invention. Tonal Filter 100 functions effectively as a combination tone control, roll-off filter and notch filter to provide an overall flatter tone response, while eliminating undesirable frequencies. The specific component values of tonal filter 100 are illustrated in FIG. 5. Tonal filter 100 desirably is in the form of a hybrid electronic chip which could be manufactured in a suitable manner given the electrical component values illustrated in FIG. 5.

Figure 6A:
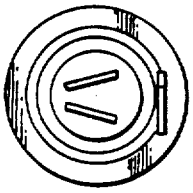
FIGS. 6A, 6B and 6C depict front, side and back views, respectively, of a preferred embodiment of an electrical jack to be incorporated into the present invention.
Figure 6B:
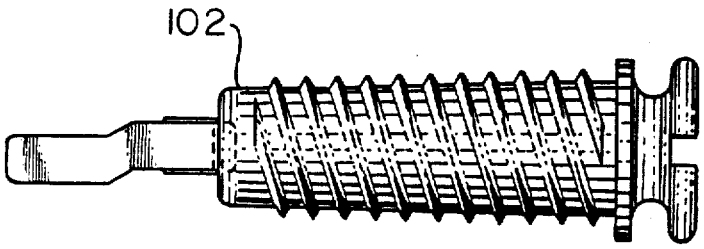
Figure 6C:
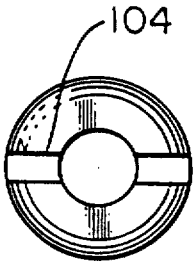

FIGS. 6A, 6B and 6C depict views of a preferred jack 102 which provides further advantages for the present invention.

FIG. 6B depicts a side view of jack 102, which includes self-tapping wood threads. This feature of jack 102 enables the present invention to be screwed into the body of an acoustic instrument such as guitar 12 of FIGS. 1 and 2, near the end block 20. This screw-in capability eliminates the need for washers and/or nuts such as illustrated in FIGS. 3 and 4. An installer only needs to drill a suitable size hole into the end block of an acoustic guitar, then merely "screw" jack 102 (together with the necessary condenser microphone and tone filter 100) into the drilled hole. By using a suitable key (not shown) inserted into slot 104 illustrated in FIG. 6C, an installer can easily install the present invention into an acoustic guitar by external means, thus obviating the need to tighten or lock the invention by internal means.

Jack 102 is preferably nickel plated, and includes the desired three terminals, as illustrated in FIG. 6A, which have the same purposes as the terminals illustrated in FIGS. 3 and 4. The preferred dimensions of jack 102 are also illustrated in FIGS. 6A, 6B and 6C.

It has been observed that the present invention dramatically improves the problem of the "hollow" sound present in prior art devices. The present invention, by utilizing a condenser microphone within the body of an acoustic guitar, generates electrical signals corresponding not to just the sound of the vibrating strings or the vibration of the wood but, in addition, generates electrical signals corresponding to the harmonics generated within the body of an acoustic guitar. The result is a dramatic improvement over prior art devices for amplifying the sound of an acoustic instrument.

In order to retrofit any acoustic instrument such as an acoustic guitar, one of ordinary skill in the art need only drill a hole in the end block 42 of the acoustic guitar to accommodate the electrical female jack, such as jack 102 of FIG. 6B. As previously described, an installer need only screw in jack 102, thus providing installation via an external means. Jack 102 is carrying or supporting a condenser microphone. The adaptation of a male plug into jack 102 provides the needed electrical connection for completing the circuit of a condenser and a power supply. The apparatus of FIG. 3 can also provide a means for supporting a carrying strap when used in an acoustic guitar. In addition, future manufacturing of acoustic guitars can incorporate the aspects of the present invention by including apparatus such as depicted in FIG. 6B at time of manufacture.

As previously described, power supply (battery) 90 of FIG. 4 could be supported by a Velcro strip, desirably near the sound hole for ease of replacement when necessary. However, the battery could be placed virtually anywhere.

While a condenser microphone is desired in a preferred embodiment, a pressure transducer type of microphone could be utilized in other embodiments.

With an electrical jack connected to the condenser microphone such as illustrated in FIG. 4, it has been observed that any "hum" from an amplifier such as illustrated in FIG. 1 is minimized or eliminated. Condenser microphone 80 is responsive to acoustic sound waves within the body of the instrument (the acoustic guitar) and provides electrical signals corresponding more truly to the acoustic sounds generated by the instrument than prior art approaches.

What is claimed is:

1. In an acoustic instrument, the apparatus comprising electrical jack means carried within the body of said acoustic instrument, said electrical jack means having self-tapping threads formed thereon to provide an intimate contact over an extended area between the body of said jack means and the material of said acoustic instrument, thus enabling secure installation of the jack means completely from the exterior of the instrument without need for internal locking or tightening, and condenser microphone means directly connected and supported by said electrical jack means in close proximity to one end of said electrical jack means within said acoustic instrument such that said microphone means is located sufficiently close to the internal body of said acoustic instrument but spaced therefrom for generating electrical signals corresponding solely to the natural or true undistorted acoustic sound within said acoustic instrument when said instrument is played.

2. The apparatus of claim 1 including tonal filter means matched to said acoustic instrument and carried by said electrical jack means for providing a flatter tonal response where said tonal filter means provides control over the passband characteristics to include high pass, low pass and/or band pass filtering.

3. The acoustic instrument of claim 2 wherein said instrument is an acoustic guitar.

4. The apparatus of claim 3 wherein said electrical jack means and said microphone means are located in the end block of said acoustic guitar.

5. The apparatus of claim 4 wherein said electrical jack means includes a female electrical jack adapted to receive a male plug and wherein said male plug is adapted to be connected to a sound amplifier for amplifying said electrical signals.

6. The apparatus as in claim 5 wherein said microphone means includes power supply means carried within the body of said acoustic guitar for supplying power to said microphone means.

7. An acoustic instrument comprising means for generating acoustic musical sounds, electrical jack means carried within the body of said acoustic means, said electrical jack means having self-tapping threads formed thereon to provide an intimate contact over an extended area between the body of said jack means and the material of said of said acoustic instrument, thus enabling secure installation of the jack means completely from the exterior of the instrument without need for internal locking or tightening, and condenser microphone means directly connected to and supported by said electrical jack means in close proximity to one end of said electrical jack means within said acoustic instrument spaced from the instrument for generating electrical signals corresponding solely to the natural or true undistorted acoustic waves within said acoustic instrument when said instrument is played.

8. The apparatus of claim 7 including tonal filter means carried by said electrical jack means for providing a flatter tonal response where said tonal filter means provides control over the passband characteristics to include high pass, low pass and/or band pass filtering.

9. In an acoustic instrument having a suitable sized hole formed therethrough such as through an end block, the apparatus comprising electrical jack means adapted to be extended through said hole so as to be carried within the body of said acoustic instrument when said instrument is played, said electrical jack means having self-tapping threads formed thereon to be threaded to the walls of said hole to provide an intimate contact over an extended area between the body of said jack means and the material of said acoustic instrument at the installation site in said instrument, thus enabling secure installation of the jack means completely from the exterior of the instrument without need for internal locking or tightening, condenser microphone means connected to and supported by said electrical jack means in close proximity to one end of said electrical jack means within said acoustic instrument such that said condenser microphone means are contained within, spaced from and near the end of the body of said instrument, said condenser microphone means being located sufficiently close to the internal body of said acoustic instrument for generating electrical signals corresponding solely to the natural or true undistorted acoustic sound of said acoustic instrument.

10. The acoustic instrument of claim 9 wherein said instrument is an acoustic guitar.

11. The apparatus of claim 10 wherein said electrical jack means and said condenser microphone means are located in the end block of said acoustic guitar to facilitate ease of installation.

12. The apparatus of claim 11 wherein said electrical jack means includes a female electrical jack adapted to receive a male plug and wherein said male plug is adapted to be connected to a sound amplifier for amplifying said electrical signals.

13. The apparatus of claim 12 wherein said microphone means includes power supply means carried within the body of said acoustic guitar for supplying power to said microphone means.

14. An acoustic instrument comprising acoustic means for generating acoustic musical sounds, said acoustic means having a suitable sized hole formed through the body thereof, such as through an end block, electrical jack means adapted to be extended through said hole so as to be carried within the body of said acoustic means when said instrument is played, said electrical jack means having self-tapping threads formed thereon to provide an intimate contact over extended area between the body of said jack means and the material of said acoustic instrument at the installation site in said instrument, thus enabling secure installation of the jack means completely from the exterior of the instrument without need for internal locking or tightening, and condenser microphone means having a frequency response substantially within the audio range of said instrument and connected to and supported by said electrical jack means in close proximity to said electrical jack means such that said condenser microphone means are fixedly contained within the end of the body of said instrument, said condenser microphone means being located sufficiently close to and spaced from the internal body of said acoustic instrument for generating electrical signals corresponding to the natural or true undistorted acoustic sounds within said acoustic instrument.

* * * * *

UNITED STATES PATENT AND TRADEMARK OFFICE

CERTIFICATE OF CORRECTION

PATENT NO. : 4,995,293

DATED : February 26, 1991

INVENTOR(S) : Peter N. Anderson

It is certified that error appears in the above-identified patent and that said Letters Patent is hereby corrected as shown below:

In the drawings, delete Fig. 5 and 6A,6B, and 6C and replaced with the Figures 5, 6A,6B,6C as shown on the attached page.

Signed and Sealed this

Twenty-second Day of March, 1994

*Attest:*

Bruce Lehman

BRUCE LEHMAN

*Attesting Officer*

*Commissioner of Patents and Trademarks*